United States Patent [19]

Rhoads

[11] Patent Number: 4,513,860

[45] Date of Patent: Apr. 30, 1985

[54] BOTTLE CARRIER

[75] Inventor: Roger R. Rhoads, Toledo, Ohio

[73] Assignee: Owens-Illinois, Inc., Toledo, Ohio

[21] Appl. No.: 530,567

[22] Filed: Sep. 9, 1983

[51] Int. Cl.[3] ..... B65D 85/62; B65D 71/02

[52] U.S. Cl. ..... 206/150; 206/158; 206/161

[58] Field of Search ..... 206/150–159, 206/161; 294/87.2, 87.28

[56] References Cited

U.S. PATENT DOCUMENTS

| | | | |
|---|---|---|---|
| 3,084,792 | 4/1963 | Poupitch | 206/150 |
| 3,721,337 | 3/1973 | Braun et al. | 206/150 |
| 3,727,754 | 4/1973 | Cunningham | 206/150 |
| 3,784,003 | 1/1974 | Bolton | 206/158 |
| 3,874,502 | 4/1975 | Wearer | 206/158 |

*Primary Examiner*—William T. Dixson, Jr.
*Assistant Examiner*—Brenda J. Ehrhardt
*Attorney, Agent, or Firm*—Thomas L. Farquer; Steve M. McLary

[57] ABSTRACT

A bottle carrier for carrying a plurality of bottles having a body portion and a neck portion and a closure which is attached to the neck of the bottle which comprises a generally flat blank formed of a material that is flexible and elastic. The blank comprises a first part defining a central portion and a second part defining a band which is severable from the first part and is adapted to be stretched about a group of bottles. The first part comprises a plurality of openings in spaced rows for receiving the necks of the containers and engaging the necks below the closures. In order to meet the requirements of adequately securing the bottles in the carrier and at the same time, being able to apply the carrier to the bottles rapidly by automatic machines, the carrier includes the following relationships: (1) minimum widths of the webs between the openings for receiving the necks of the bottles and the periphery of the carrier, (2) the stress on the webs must be less than 550 p.s.i., (3) any radii in the band must be at least $\frac{7}{8}''$ or greater, (4) the average stretch ratio of the band should be about 8% to 14%.

10 Claims, 2 Drawing Figures

BOTTLE CARRIER

This invention relates to bottle carriers and particularly to bottle carriers for carrying a plurality of bottles having narrow necks with closures thereon.

BACKGROUND AND SUMMARY OF THE INVENTION

In the use of cans and bottles, it has heretofore been proposed that carriers be provided to facilitate the handling. More specifically, it has been proposed that the carrier comprise a sheet of flexible and elastic material having a plurality of openings through which the upper ends of the cans or necks of the bottles extend and are held to provide a pack of cans or bottles. Such a carrier has been extensively used in connection with cans. However, the use of such carriers for bottles having narrow necks such as conventionally used for soft drinks and beer has not been extensive because the bottles must be secured in the carrier so that they can be readily handled and at the same time can be easily removed without excessive force.

In the handling of bottles, carriers that have been proposed are such as shown in U.S. Pat. Nos. 3,084,792, 3,727,754 and 3,784,003 wherein a sheet of flexible elastic material comprises an inner part having the openings through which the upper ends of the necks extend and a peripheral band that is severed from the first part and moved about the periphery of the group of bottles to form and complete the package.

The use of such a carrier requires careful design since the nature of the carrier restricts the amount of material that can be used. The configuration and size of the periphery of the group of bottles that are to be carried determines the general size of the outer part or band leaving the inner part restricted to the area surrounded by the outer part. Thus the inner part should be designed to secure the bottles so they can be readily handled and at the same time easily removed without excess force.

At the same time in order to utilize the carrier, it is applied by machines which have fingers that are inserted within the outer part or band and stretch the loop so that it can be moved downwardly about the periphery of the group of bottles. Such a method and apparatus necessitates a relatively rapid stretching of the band. It is thus necessary that the band retain its strength and not unnecessarily exceed the elastic limit of the material during this rapid stretching.

As far as is known, the carrier of the aforementioned patents have not met all the requirements of a satisfactory carrier.

Accordingly among the objectives of the present invention are to provide a carrier for bottles which adequately secures the bottles and at the same time permits the bottles to be removed without excessive force; which utilizes the minimum amount of material; and which can be readily applied to the bottles at high rates without adversely affecting the strength of the carrier.

In accordance with the invention, the bottle carrier for carrying a plurality of bottles having a body portion and a neck portion and a closure which is attached to the neck of the bottle which comprises a generally flat blank formed of a material that is flexible and elastic. The blank comprises a first part defining a central portion and a second part defining a band which is severable from the first part and is adapted to be stretched about a group of bottles. The first part comprises a plurality of openings in spaced rows for receiving the necks of the containers and engaging the necks below the closures. In order to meet the requirements of adequately securing the bottles in the carrier and at the same time, being able to apply the carrier to the bottles rapidly by automatic machines, the carrier includes the following relationships: (1) minimum widths of the webs between the openings for receiving the necks of the bottles and the periphery of the carrier, (2) the stress on the webs must be less than 550 p.s.i., (3) any radii on the band must be at least $\frac{7}{8}''$ or greater, (4) the average stretch ratio of the band should be about 8% to 14%.

DESCRIPTION

Figure 1:
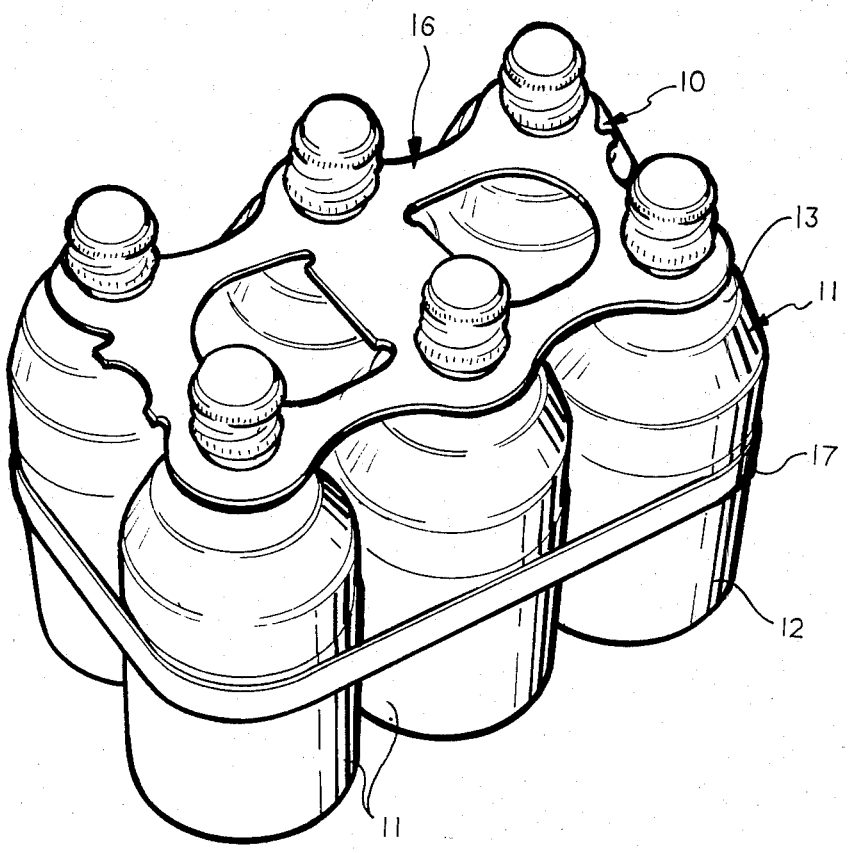
FIG. 1 represents a perspective view of the bottle carrier of the present invention in use.
Figure 2:
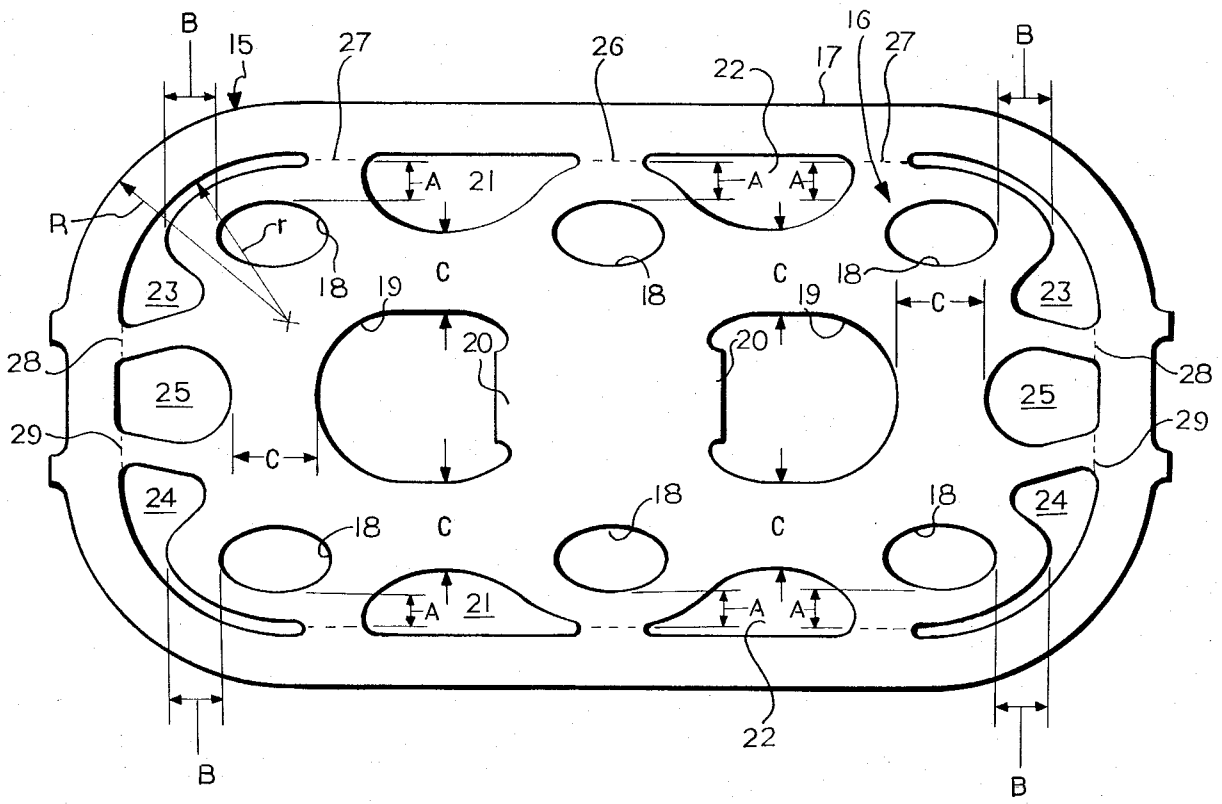
FIG. 2 represents a plan view of the bottle carrier of the present invention.

Referring to FIGS. 1 and 2, the bottle carrier for carrying a plurality of bottles 10 having a body portion 11 and a neck portion 12 and a closure 13 which is attached to the neck of the bottle which comprises a generally flat blank 15 formed of a material that is flexible and elastic. A preferred material is low density polyethylene (LDPE). The blank comprises a first part 16 defining a central portion and a second part 17 defining a band of substantially uniform width which is severable from the first part and is adapted to be stretched about a group of bottles. The first part 16 comprising a plurality of openings 18 in spaced rows for receiving the necks of the containers and engaging the necks below the closures.

The central portion 16 of the carrier further includes a pair of centrally located longitudinally spaced finger receiving openings 19 the inner edges of which are formed with a short flap 20 that folds downwardly as the two fingers are inserted in the openings to carry the package of containers. When the carrier is applied to the necks of the containers, the peripheries of the openings 18 are deformed upwardly and the portions of the carrier between the two rows of openings are stretched.

In order to properly secure the bottles in the openings, where the closures are crimped or rolled on, the openings 18 are preferably in the configuration of an isometric ellipse that has its long axis extending longitudinally in the direction of each row. Such an opening 18 has been found to be preferred in holding bottles with rolled on or crimped closures that have a fillet at the juncture of the closure and container. It has been found that such opening configurations adequately hold the bottles and at the same time permit the bottles to be removed without excessive force. The configurations of the openings are more adequately described in my applications Ser. No. 530,823, filed Sept. 9, 1983 and Ser. No. 530,566, filed Sept. 9, 1983, which are being filed concurrently herewith. Where the closures are of plastic and have an undercut, the openings preferably have a configuration such as shown in the application Ser. No. 530,823.

The aforementioned applications are incorporated herein by reference.

The carrier further includes cut out portions or openings 21, 22 along the sides, cut out portions 23, 24 at the corners and cut out portions 25 at the ends which define the weakened portions 26, 27 and 28, 29 along which the band 17 is severed. The cut out portions also function to conserve material.

In order to meet the requirements of adequately securing the bottles in the carrier and at the same time, being able to apply the carrier to the bottles rapidly by automatic machines, I have determined that the following relationships must be adhered to:

1. Minimum widths of the webs between the openings for receiving the necks of the bottles and the periphery of the carrier.
2. The stress on the webs must be less than 550 p.s.i.
3. Any radii in the band must be at least $\frac{7}{8}$" or greater.
4. The average stretch ratio of the band should be about 8% to 14%.

Width of the Webs

In accordance with the invention, it has been found that in order to adequately secure the bottles without tearing the material, it is necessary that certain relationships be provided between various webs extending from the openings 18 to the periphery of the first part or central portion 16 of the carrier. Specifically, the width of the web A between the central opening is in each row and the periphery of the first part of the carrier must be a minimum in accordance with the following table:

| Package | Total Package Weight (Lbs.) | Thickness (Mil) | Web Width |
|---|---|---|---|
| 10 Ounce glass (6 pack) | 6.0 | 18 | 3/16" |
| $\frac{1}{2}$ Liter plastic (6 pack) | 6.9 | 18 | 3/16" |
| 10 Ounce glass (8 pack) | 8.0 | 22 | $\frac{1}{4}$" |
| 16 Ounce glass (8 pack) | 9.0 | 22 | $\frac{1}{4}$" |

Further, it has been found that the web B between the endmost opening 19 and the periphery of the carrier at the openings 23, 24 should be at least $\frac{1}{8}$" greater than the width of the first web A.

In addition, it has been found that the dimension C between the edge of each central finger receiving opening 19 and the periphery of the carrier at openings 21, 22 and 25 should be at least that of the first web A and somewhat less than the width of the second web B, namely, $$C \geqq A < B$$

It has been found that inasmuch as the carriers are cut from a continuous roll that is made in a machine operation, the sheet is anisotropic and will tear more readily in the machine direction than in the transverse direction so that the third web C must be greater in width.

Stress in the Webs It has further been found that there is an optimum relationship between the total package weight, web width and sheet thickness as follows:

$$\text{Stress} = \frac{\text{Package weight (lbs.)}}{\text{Web width (in.)} \times \text{Thickness (in.)}}$$

In tests that have been conducted, in order that a package will pass all drop tests which are required the stress must be less than 550 p.s.i.

Radii in the Band

Further in accordance with the invention it has been found that in order to permit the band to be applied by automatic machines that operate at relatively high speeds, it is necessary to be able to stretch the band rapidly, for example within three seconds without incurring neckdown due to exceeding the yield strength of the band.

As the band is stretched, the inside perimeter of the band moves from a position in the plane of the carrier to a vertical position before the outside perimeter of the band moves from a position in the plane of the carrier in a vertical position before the outside perimeter of the band begins to stretch. In other words during the application of the band, the inside perimeter of the band first stretches until it becomes equal to the outside perimeter and thereafter further stretching occurs.

It has been found that it is desirable to reduce the first stage stretch and in order to do this for an 18 mil material, the inside radius R should be a minimum of $\frac{7}{8}$" for a carrier 18 mil thick to reduce the stretch time.

This requirement is based on the following analysis and work. A neckdown is a significant localized reduction in width of the band caused by significantly exceeding the yield point of the LDPE material. This is esthetically displeasing as well as causing a reduction in the elasticity of the material. Thus it will not snap back as fully when released and will not secure the bottles as well than if it has been released prior to neckdown.

Similar neckdown does not occur when the band is hand applied by banding five bottles loosely and forcing the sixth into place thus stretching the band an absolute minimum amount. However, for commercial machine application it is desirable to stretch the band so as to clear all grouped bottles by $\frac{1}{8}$" per side over the minimum manufactured bottle diameter.

An example of this is a carrier used for glass bottles. The minimum perimeter of a 6 pack using nominal diameter bottles is 24.42". The average length of the band is 22.19. Thus the band must stretch a minimum of 10.0% to go around the bottles. However, assuming a possible increase in bottle diameter of 0.030" (production tolerance) and a band clearance of $\frac{1}{8}$" on all four sides, one mechanism designed to apply the band would stretch the band to 27.06" or 21.9%.

It was found that only with very slow stretching (greater than 10 sec.) could a 5/16" wide band with a corner radius of 9/16" be applied without neckdown. A commercially desirable machine would package 120 6 packs per minute. Assuming $\frac{1}{2}$ of the machine cycle could be used to stretch the band prior to application, then at least 40 heads would be required on the machine. If on the other hand the time to stretch could be reduced to three seconds then only 12 heads would be required. Thus reducing the stretch time without incurring neckdown is desirable.

In order to reduce this stretch time to neckdown, a number of variables were investigated. First, by going from a 5/16" to 7/16" wide band this stretch time was reduced from greater than 10 seconds to $4\frac{1}{2}$ seconds. Also since the 7/16" wide band has a greater elastic force (due to greater cross-sectional area) the 6 pack is held together more tightly.

Secondly, a mathematical analysis of the band design shows that when the band stretches, the inside perimeter of the band goes from horizontal to vertical before the outside perimeter begins stretching. Therefore, the first stage of stretching is for the inside perimeter to become equal to the outside. All of this stretching occurs in the corners and a mathematical equation can be writen as follows:

$$\frac{R-r}{r} \times 100 = \%\text{ inside perimeter stretch}$$

where R is the outside radius and r is the inside radius.

If R=$\frac{7}{8}$" and r=9/16", the first stretch is 56%. Add to this the second stage stretch of 19% and the total is 75%.

To reduce this first stage stretch, it is necessary to increase the inside radius. Tests have shown that for 18 mil material, an inside radius of $\frac{7}{8}$" for 18 mil reduces the critical stretch time to $1\frac{1}{2}$ to 2 seconds.

Maintaining the same band length and increasing the inside radius from 9/16" to $\frac{7}{8}$" increases the overall carrier length by about $\frac{1}{8}$". Going from 9/16" inside radius reduces the critical stretch time to about 1 second but increases the carrier length (for the same band length) by $\frac{5}{8}$". Further increases in the inside radius has no further significant effect on the critical stretch time.

Thirdly, I found that material thickness has an effect on the critical stretch time as well. Increasing the thickness increases the stretch time to neckdown. For example, at 18 mils a $1\frac{1}{8}$" inside radius design has a critical time of 1 second. At 22 mils, this time increases to 5 seconds which may be unacceptable for a practical commercial machine design. However, by increasing the inside radius to $1\frac{1}{2}$" for 22 mil material the critical time is decreased to an acceptable 2 to $2\frac{1}{2}$ seconds.

Stretch Ratio

It has been further found that in order that the band will properly contain the bottles without slipping so that the package will pass the necessary drop test without exceeding the yield strength and causing neckdown of the band, the band should have a predetermined stretch ratio between the length of the band and length of the periphery of the group of bottles.

More specifically, in the case of a sheet of low density polyethylene, it has been found that the average stretch should be 8–14 percent with a stretch of 9–12 percent being preferred. If the stretch ratio is less, the band will slip off during testing. If the stretch ratio is greater, a neckdown or excessive stretch of the band will occur. Further, a high stretch percentage will cause design problems in not allowing enough area inside the band for proper design of the bottle finish portion of the carrier.

A study was made to define the optimum band stretch for both 10 ounce and 16 ounce glass bottles. In each case the average length of the band as designed (flat) was compared to the overall perimeter of a six pack. Bands were cut out and band applied such that they were stretched on absolute minimum.

For the 10 ounce bottler version (total filled weight, 6 ounce), the starting point was 10.0% stretch. Increments of $\frac{3}{8}$" were added or subtracted from the length so that a range of 6.4 to 18.0% was covered. The neckdown characteristics were noted and selected six packs were put through the standard drop test. At 13.8% stretch, neckdown of the band occurred unless the stretch rate was very slow, probably slower than could be done at a commercial rate. At 6.4% the band was quite loose. However, it did pass the drop test where the bottles had a foam plastic label. If the bottles were bare or covered with paper labels, the band would have prematurely slipped off.

For the 16 ounce bottle (total filled weight, 24 ounces), the starting point was 10.7% stretch. Again increments of $\frac{3}{8}$" were used and similar criteria applied. A range of 7.4 to 14.2% was covered. At 14.2%, again a slow and impractical rate of stretch was needed to apply the band and avoid neckdown. At 7.4% stretch, the band was so loose that it slipped off the bottles after only about 50 drops.

When carriers are made in accordance with these relationships and used to make a bottle package, the package will pass a drop test of 100 $1\frac{1}{2}$" strokes.

I claim:

1. A bottle carrier for carrying a plurality of bottles having a body portion and a neck portion and a closure which is attached to the neck of the bottle which comprises a generally flat blank formed of a material that is flexible and elastic, said blank comprising a first part defining a central portion and a second part defining a band which is severable from the first part and is adapted to be stretched about a group of bottles, said first part comprising a plurality of openings in spaced rows for receiving the necks of the containers and engaging the necks below the closures, said carrier including webs between the bottle openings and the periphery of the first part, the stress on the webs being less than 550 p.s.i., the stress being determined as follows:

$$\text{stress} = \frac{\text{package weight (lbs.)}}{\text{wed width (in.)} \times \text{thickness (in.)}},$$

any radii in the band being at least $\frac{7}{8}$" or greater, the average stretch ratio of the band between the length of the band and the length of the periphery of the bottles engaged by the band is about 8% to 14%.

2. The carrier set forth in claim 1 wherein the width of the webs A between each bottle receiving opening and the peripheral side of the central portion of the carrier, the width of the webs B between each bottle receiving opening on the end of the carrier and the peripheral end of the central portion of the carriers and the width of the webs C between the bottle receiving openings and the periphery of the carrier having the relationship:

$$C \geqq A < B.$$

3. A bottle carrier for carrying a plurality of bottles having a body portion and a neck portion and a closure which is attached to the neck of the bottles which comprises a generally flat blank formed of a material that is flexible and elastic, said blank comprising a first part, said first part comprising a plurality of openings in spaced rows for receiving the necks of the containers and engaging the necks below the closures, said carrier including webs between the bottle openings and the periphery of the first part, the stress on the webs being less than 550 p.s.i., the stress being determined as follows:

$$\text{stress} = \frac{\text{package weight (lbs.)}}{\text{web width (in.)} \times \text{thickness (in.)}}.$$

4. The carrier set forth in claim 3 wherein the width of the webs A between each bottle receiving opening and the peripheral side of the central portion of the carrier, the width of the webs B between each bottle receiving opening on the end of the carrier and the peripheral end of the central portion of the carrier and the width of the webs C between the bottle receiving openings and the periphery of the carrier have the relationship:

$$C \geqq A < B.$$

5. The bottle carrier set forth in claim 4 wherein said carrier includes a band which is severable from the first part and is adapted to be stretched about a group of bottles.

6. A bottle package comprising a plurality of bottles having a body portion and a neck portion and a closure which is attached to the neck of the bottle which comprises a generally flat blank formed of a material that is flexible and elastic, said blank comprising a first part, said first part comprising a plurality of openings in spaced rows for receiving the necks of the containers and engaging the necks below the closure, said carrier including webs between the bottle openings and the periphery of the first part, the stress on the webs being less than 550 p.s.i., the stress being determined as follows:

$$\text{stress} = \frac{\text{package weight (lbs.)}}{\text{web width (in.)} \times \text{thickness (in.)}}.$$

7. The bottle package set forth in claim 6 wherein the width of the webs A between each bottle receiving opening and the peripheral side of the central portion of the carrier, the width of the webs B between each bottle receiving opening on the end of the carrier and the peripheral end of the central portion of the carrier and the width of the webs C between the bottle receiving openings and the periphery of the carrier have the relationship:

$$C \geqq A < B.$$

8. The bottle package set forth in claim 7 wherein said carrier includes a second part defining a band which is severable from the first part and is adapted to be stretched about a group of bottles, and radii in the band is at least $\frac{7}{8}''$ or greater, the average stretch ratio of the band is about 8% to 14%.

9. A bottle carrier for carrying a plurality of bottles having a body portion and a neck portion and a closure which is attached to the neck of the bottle which comprises a generally flat blank formed of a material that is flexible and elastic, said blank comprising a first part defining a central portion and a second part defining a band which is severable from the first part and is adapted to be stretched about a group of bottles, said first part comprising a plurality of openings in spaced rows for receiving the necks of the containers and engaging the necks below the closures, said carrier including webs between the bottle openings and the periphery of the first part, the stress on the webs being less than 550 p.s.i., the stress being determined as follows:

$$\text{stress} = \frac{\text{package weight (lbs.)}}{\text{wed width (in.)} \times \text{thickness (in.)}},$$

and radii in the band being at least $\frac{7}{8}''$ or greater.

10. The carrier set forth in claim 9 wherein the average stretch ratio of the band is about 8% to 14%.

* * * * *